United States Patent [19]

Condon et al.

[11] Patent Number: 4,653,227

[45] Date of Patent: Mar. 31, 1987

[54] DOOR OPERATING ASSEMBLY

[75] Inventors: James E. Condon, Woodland, Calif.; Nicholas B. Shankland, Chicago, Ill.

[73] Assignee: Vapor Corporation, Chicago, Ill.

[21] Appl. No.: 786,779

[22] Filed: Oct. 11, 1985

[51] Int. Cl.[4] ..... E05C 7/06

[52] U.S. Cl. ..... 49/110; 49/111; 49/338

[58] Field of Search ..... 49/110, 111, 109, 115, 49/274

[56] References Cited

U.S. PATENT DOCUMENTS 2,893,506 7/1959 Daugirdas ..... 49/110 X
4,454,685 6/1984 van der Sloot et al. ..... 49/110

FOREIGN PATENT DOCUMENTS 481990 3/1938 United Kingdom ..... 49/115

*Primary Examiner*—Kenneth Downey
*Attorney, Agent, or Firm*—Francis J. Lidd

[57] ABSTRACT

A door operating assembly for opening and closing vehicle doors at a constant door edge force includes a frame. A teeter lever assembly is pivotally mounted on the frame and is connected to a connecting rod assembly connecting the teeter lever assembly and the vehicle doors. A cylinder is mounted on the frame and includes a reciprocally mounted rod. The rod is reciprocated by pressurized air introduced into the cylinder. The rod is connected to the teeter lever assembly to rotate the teeter lever assembly. The teeter lever assembly includes a variable diameter cam. A spring for closing the doors is secured at a first end to the frame and at a second end to a flexible connection member. The flexible connection member connects the spring to the cam and wraps around the outer periphery of the cam upon door opening. The energy stored in the spring at full extension is used to close the doors. To maintain the force on the doors constant during opening and closing, the cam provides a larger moment arm in the door closed position than the door open position. To provide closing force for the door an accumulator may be provided. The accumulator includes a container in fluid communication with a vent in the cylinder. As the doors open, air in the cylinder is forced out the vent and into the container. During door closing, air accumulated in the container reenters the cylinder to extend the rod and close the door. An adjustable relief valve may be included with the container to maintain pressure in the container below the source pressure for the cylinder.

28 Claims, 7 Drawing Figures

FIG. 1 PRIOR ART
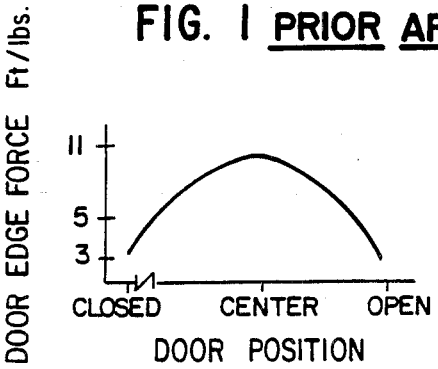
FIG. 2
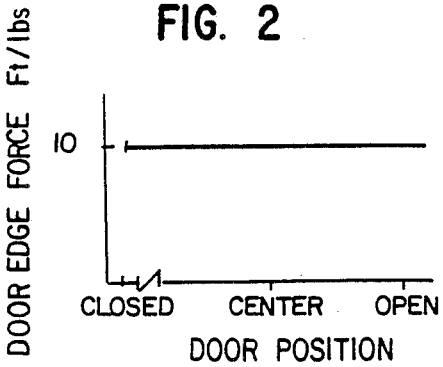
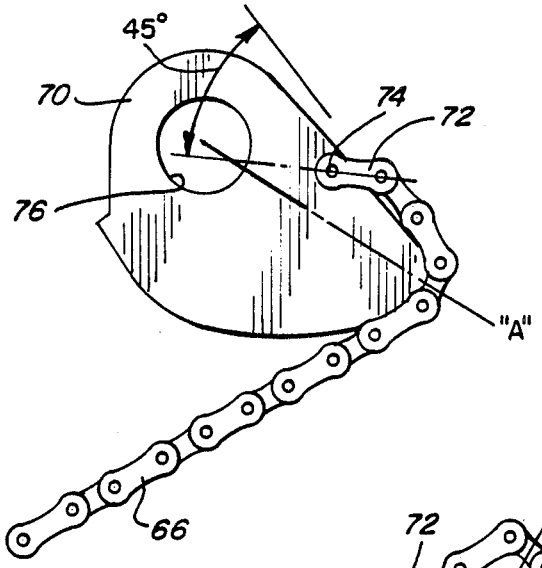
FIG. 4
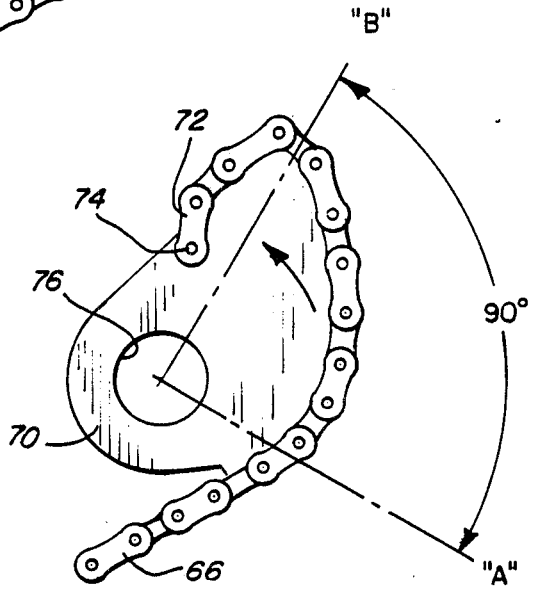
FIG. 5

DOOR OPERATING ASSEMBLY

BACKGROUND OF THE INVENTION

A. Field of the Invention

The present invention relates to a new and improved door operating assembly for opening and closing vehicle doors; and more particularly, to a new and improved door operating assembly for closing vehicle doors with a closing force that insures the doors are closed despite adverse conditions.

B. Description of the Background Art

In the interest of operation efficiency and passenger safety, transit vehicles such as buses, typically include an interlock system that prevents the bus from moving when one of the rear doors is ajar. In prior art door operating assemblies of the type disclosed in U.S. Pat. No. 3,010,433 the operator of the vehicle pressurizes a cylinder with a reciprocating rod to open the rear doors. Other power door installations utilize so-called air-open, spring-close door systems wherein exiting passengers initiate power door opening by energization of door operating cylinders or other door opening devices. A system of this type is described in Bulletin TW8-3-14, supplied by the assignee of this application. This bulletin is hereby incorporated by reference.

After the passenger exits the vehicle through the rear door and after a predetermined time delay, air is removed from the cylinder and a spring, elongated during opening of the doors, acts to close the doors. Typically, in this arrangement, the maximum door edge force occurs at mid stroke of the doors with greatly reduced forces at door opening and closing locations.

A small closing force may result in problems, such as incomplete door closing. This problem is exacerbated over time and is due to frictional buildup and linkage tolerances further reducing the effective spring force at closing. With reduced spring force, situations such as high crowned streets or doors of unexpected weight can impose a gravity force that sufficiently counteracts the effective spring force and prevents complete door closing.

When the door does not completely close, the bus cannot be operated due to the interlock system. In this situation, in some cases, vehicle operators misadjust the door limit switches in attempting to allow bus operation with partially closed doors resulting in unsatisfactory door and vehicle operation.

One solution to the problem of partial closing doors is to increase the force imparted to the door at the point in the cycle that the door approaches the completely closed position. In prior art systems, this has not been possible since the nature of springs is to impart the greatest force when the spring is fully extended which occurs at the mid stroke of the door. It is desirable to provide an assembly that may be added to existing door operating assemblies to provide increased force to close doors completely.

SUMMARY OF THE INVENTION

An object of the present invention is to provide a new and improved operator for transit vehicle doors.

Another object of the present invention is to provide a new and improved door operator for transit vehicles that provides sufficient door closing force to insure complete closure throughout the life of the doors and under all conditions experienced by the vehicle.

A further object of the present invention is to provide a new and improved assembly for completely closing transit vehicle doors that can be retrofitted on existing door operating assemblies.

A still further object of the present invention is to provide a new and improved door operating assembly that provides a uniform door edge force throughout the entire opening and closing cycle of a door in a transit vehicle.

Briefly, the present invention is directed to a new and improved door operator for transit vehicles and, specifically, for the rear doors of transit vehicles. The door operator of the present invention is intended to insure complete closure of the doors despite linkage tolerances and frictional build up due to wear. This is accomplished by increasing the closure force developed by the door operator and imposed on the door at closing.

The door operator includes a frame, mounted to the vehicle above a rear door. The door is defined by a pair of panels simultaneously opened outwardly by means of an air-open, spring-close piston and cylinder assembly which activates a teeter lever assembly mounted on the frame. The teeter lever assembly is connected to each door panel by an adjustable connecting rod assembly. The door may be opened once the vehicle driver unlocks the teeter lever assembly. Once unlocked, a passenger presses a touch bar or similar activating device to energize a source of pressurized fluid. Pressurized fluid is fed to the piston and cylinder assembly which rotates the teeter lever to open the doors. Once the passenger has departed, the door is closed by a return spring mounted at a first end on the frame. A second end of the spring is connected to a flexible connection member such as a link chain. The link chain wraps partially around the outer periphery of a variable rate cam mounted on and rotatable with the teeter lever assembly. In the door closed position, the cam defines a first moment arm between the point of rotation of the cam and the point of tangency of the chain. As the door is opened, the chain wraps around the periphery of the cam extending the spring. During door opening, the moment arm is progressively reduced until the full open position at which point the moment arm is shorter than the moment arm at the door closed position. Since the stored energy in the spring at the door open position is greater than at the door closed position, the result is the door edge force through the entire opening and closing cycle is substantially constant. This uniform or linearized force is larger in the door closed position than the closing force provided by prior art operators. The larger force of the spring and cam combination at approximately the door closed position insures complete closure of the door.

It is also possible to insure complete closure of the vehicle door by connecting the pneumatic piston and cylinder assembly to a closed container or accumulator. As the door is opened, air is forced by the piston of the piston and cylinder assembly into the container. During door closing, pressurized air in the container acts as an air spring to return the piston to its original position closing the door. The air spring provides a larger closing force compared to prior art door operators insuring complete closure of the door. To prevent the pressure in the container reaching the level of source pressure and not allowing opening of the door, and adjustable relief valve set at a value below the source pressure is connected to the container.

BRIEF DESCRIPTION OF THE DRAWINGS

The above and other objects and advantages and novel features of the present invention will become apparent from the following detailed description of a preferred embodiment of the invention illustrated in the accompanying drawings wherein:

FIG. 1 is a graphic illustration of door edge force versus door position for prior art door operating assemblies;

FIG. 2 is a graphic illustration of door edge force versus door position for a door operator constructed in accordance with the principles of the present invention;

FIG. 4 is a top plan view of a variable rate cam used in the door operator of the present invention in the door closed position;

FIG. 5 is a view of the cam illustrated in FIG. 4 in the door open position;

DESCRIPTION OF THE PREFERRED EMBODIMENT

Typically, rear doors of transit vehicles are opened and closed by door operators controlled by the driver of the vehicle and the departing passenger. The door is initially unlocked by the driver. A departing passenger may then press a touch bar to energize an air cylinder that opens the door. After the passenger exits the vehicle, air is vented from the air cylinder and a return spring closes the door. The door edge force relative to door position for these prior art door operators is illustrated in FIG. 1. The force at the closed and open positions of the door is approximately three pounds while at the center position between open and closed positions the force is approximately eleven pounds.

The small closure force provided by prior art door operators has significant disadvantages. Frictional build up and linkage tolerances effectively reduce the available spring force and a small opposing force can counteract the closure force preventing complete closure of the door. For example, high crown streets cause a tilting of the transit vehicle and allow gravity to act against the door to prevent the door from closing. Failure of the door to close completely can prevent operation of the vehicle since transit vehicles typically include a safety interlock to prevent the vehicle from operating until the door is fully closed.

Figure 3:
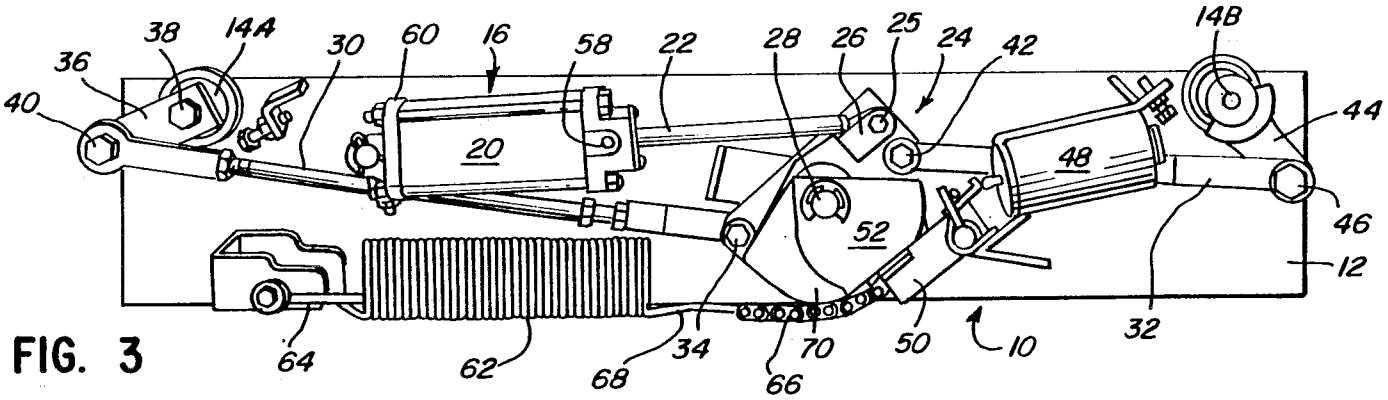
FIG. 3 is a top plan view of a door operator constructed in accordance with the principles of the present invention.

A means of providing positive door closing is to increase the door force at or near the closing position, thereby insuring complete door closure. This can be accomplished by linearizing the door edge force throughout the entire cycle. Linearized force of this type is illustrated in FIG. 2. The linear door edge force of approximately ten pounds through the entire cycle as illustrated in FIG. 2 is accomplished using the door operator generally designated by the reference numeral 10 (FIG. 3). Operator 10 is mounted in a transit vehicle over a rear door (ref. Bulletin TW8-3-14) by a frame 12. Two door panels in the rear door (not shown) of a vehicle are simultaneously opened outwardly by means of the operator 10. Each door panel is pivotally mounted on a door shaft 14A and 14B and are opened by an air-operated piston and cylinder assembly 16. Assembly 16 includes a piston 18 (FIG. 6) reciprocally mounted within a cylinder housing 20. A piston rod 22 is connected to the piston 18 and extends outside housing 20. Piston 18 is solid with a "U" cup seal 19 maintaining a seal against the cylinder wall.

The air operated piston and cylinder assembly 16 activates a teeter lever assembly 24 through a connection by a pin 25 of rod 22 to a lever 26 of the teeter lever assembly 24. Lever 26 is rotatably mounted on frame 12 by a pin 28. The teeter lever assembly 24 is connected to each door shaft 14A and 14B by a connecting rod assembly including a first connecting rod 30 and a second connecting rod 32. Connecting rod 30 is pivotally connected to lever 26 by a pin 34 and to door shaft 14A by a door shaft lever 36 and pins 38 and 40. Similarly, rod 32 is connected to lever 26 by a pin 42 and is connected to door shaft 14B by a door shaft lever 44 and pin 46.

Figure 6:
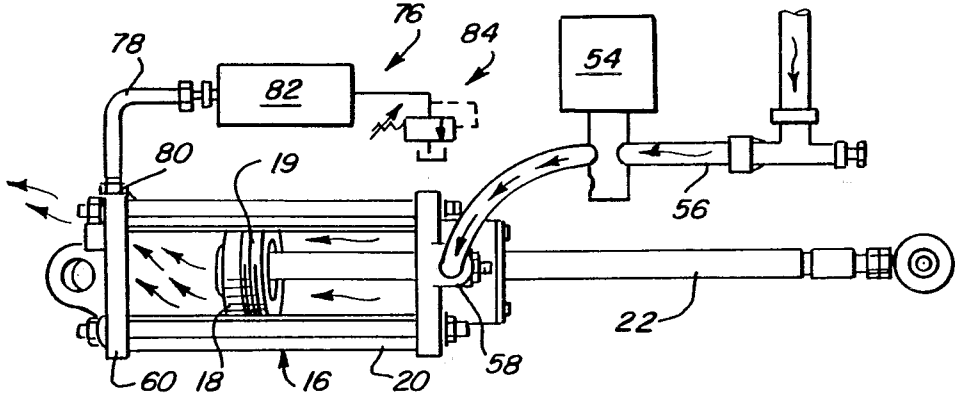
FIG. 6 is a side, partially cut away view of a cylinder of the door operator with an accumulator constructed in accordance with the principles of the present invention.

To open the door, the driver of the vehicle must deenergize an unlock solenoid 48 mounted on frame 12. Upon deenergization, solenoid 48 retracts a plunger 50 that is engaging and locking a first cam 52. Cam 52 is rigidly secured to pin 28 and in the locked condition, prevents rotation of the teeter lever assembly 24. The departing passenger then presses a touch bar that energizes air magnet valve 54 (FIG. 6). Upon energization of the magnet valve 54, pressurized air from a reservoir is allowed to flow through an air feed line 46 to an air feed line connection 58 in cylinder housing 20. Pressurized air introduced into cylinder 20 forces piston 18 to move toward a rear end cap 60. This action rotates teeter lever assembly 24 and through the connecting rods 30 and 32, the door is opened.

Upon departure of the passenger, air magnet valve 54 is deenergized and air supply to the air operated piston and cylinder assembly 16 is shut off. The door is then closed by a return spring 62. Return spring 62 is secured to frame 12 at a first end 64 and to a flexible link chain 66 at a second end 68. Chain 66 is wrapped around a portion of the outer periphery of a variable rate cam 70 and secured to cam 70 at an end 72 by a pin 74 (FIG. 4). Variable rate cam 70 includes an aperture 76 by which cam 70 is securely mounted on pin 28. Through this connection, cam 70 rotates with the teeter lever assembly 24.

FIG. 4 illustrates cam 70 in the door closed position. The point of tangency of the chain 66 and cam 70 is at the outer peripheral surface of cam 70 at line "A". The moment arm of the force of spring 62 is measured from the center of aperture 76 to the point of tangency of chain 66 with the outer peripheral surface of cam 70 at line "A". In experiments the length of this moment arm was 2.38 inches.

As the door is opened, cam 70 rotates approximately 90 degrees counterclockwise as viewed in FIG. 4 to the position illustrated in FIG. 5. This position corresponds to the open position of the door. Cam 70 is designed such that the moment arm as measured from the center of aperture 76 to the point of tangency of chain 66 progressively decreases as the door opens from the moment arm in FIG. 4 to the moment arm in FIG. 5 measured from the center of aperture 76 to the point of tangency along line "A". In the experiment mentioned above, the moment arm in the door open position was one inch.

In the door open position, spring 62 is extended more than in the door closed position and in the door open position, spring 62 applies a greater force on the door tending to close it.

At the door open position or the position of greatest extension of spring 62, the moment arm due to cam 70 is the shortest. At the point where spring 62 is extended the least (the door closed position), the moment arm is the longest. The result of this correlation of spring extension and moment arm length is a linearization of the door edge force. The door edge force at closing as developed by door operator 10 is approximately ten pounds which is significantly greater than that provided by prior art door operators. This greater closure force insures the door is completely closed despite friction build up, linkage tolerances and forces, such as gravity, tending to hold the door open. Door operator 10 insures complete closure and avoids the potentially hazardous situation prevalent in the prior art.

Figure 7:
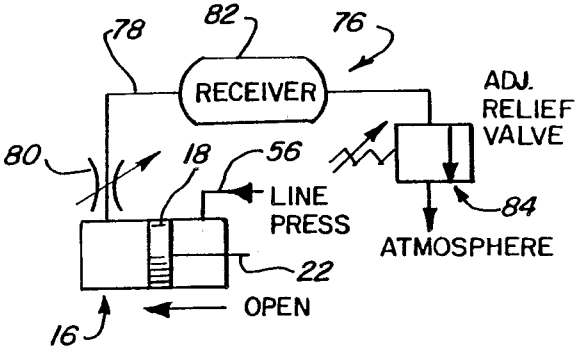
FIG. 7 is a schematic illustration of the cylinder and accumulator illustrated in FIG. 6.

It is also possible to retrofit existing door operators to insure complete closure of transit vehicle doors using an accumulator generally designated by the reference numeral 76 (FIGS. 6 and 7). Accumulator 76 operates on the principle of accumulating pressurized air during door opening and using that air as an air spring during door closing. Accumulator 76 can be installed on existing door operators by connecting an air line 78 to a cushioning vent 80 of air cylinder housing 20.

As best illustrated in FIGS. 6 and 7, as the door is opened, air from a pressurized source is introduced into cylinder housing 20 behind piston 18. Piston 18 moves within cylinder housing 20 toward rear end cap 60. As piston 18 moves in this direction, air is forced out vent 80, through air line 78 and into a closed container or receiver 82. Air is held under pressure in container 82 until the door is to be closed. At closing, magnet valve 54 terminates communication of cylinder housing 20 with the source of pressurized air and the cylinder housing 20 behind piston 18 is vented to atmosphere. The pressure accumulated in container 82 then acts as an air spring returning piston 18 to the original position with substantially greater force than provided in the prior art by return spring 62 acting alone. This increased closing force insures complete closure of the vehicle door preventing a possible hazardous situation.

Over time, seal 19 wears allowing line pressure to pass around piston 18 and accumulate in container 82. It is possible for leakage to occur until the pressure in container 82 equals line pressure. Once this occurs, piston 18 will not move in response to line pressure being introduced through air feed line 56. To avoid this problem, an adjustable relief valve 84 is connected to container 82. Adjustable relief valve 84 is set at a pressure below line pressure, such as, for example, sixty percent of line pressure. If the pressure in container 82 exceeds this setting, relief valve 84 vents excess pressure to atmosphere.

The variable rate cam 70 and accumulator 76 provide quick and inexpensive solutions to a hazardous situation resulting from the failure of the rear door of a transit vehicle to close. Cam 70 and accumulator 76 increase the closing force using existing equipment thereby insuring complete closure of the door.

Many modifications and variations of the present invention are possible in light of the above teachings. Thus, it is to be understood that, within the scope of the appended claims, the invention may be practiced other than as specifically described.

We claim:

1. A door operating assembly for operating a door of a transit vehicle, said door including first and second panels, each said first and second panel including a door shaft, said operating assembly including a frame, a teeter lever assembly and a connecting rod assembly mounted on said frame, said connecting rod assembly connected to said door shafts for said first panel and said second panel to open and close said first panel and said second panel upon extension and retraction of said connecting rod assembly, said connecting rod assembly connected to said teeter lever assembly, a cylinder mounted on said frame, said cylinder including a reciprocating rod, and a return spring secured to said frame and to said teeter lever assembly, the improvement comprising;

a cam on said teeter lever assembly, said cam rotatably mounted on said frame at a point of rotation of said cam, said reciprocating rod connected to said cam to rotate said cam, a flexible connection member also connected to said cam, said flexible connection member also connected to said spring.

2. The door operating assembly claimed in claim 1 wherein said cam is a variable rate cam.

3. The door operating assembly claimed in claim 1 wherein said cam is a variable diameter cam.

4. The door operating assembly claimed in claim 1 wherein the moment arm between said point of rotation of said cam and said spring is larger in the closed position of said door than the moment arm in the open position of said door.

5. The door operating assembly claimed in claim 1 wherein said flexible member is a link chain.

6. The door operating assembly claimed in claim 1 further comprising an accumulator assembly connected to said cylinder.

7. The door operating assembly claimed in claim 6 wherein said cylinder includes a piston cushioning vent, said accumulator including a closed container secured to said frame, means for communicating said container and said vent.

8. The door operating assembly claimed in claim 7 further comprising an adjustable relief valve coupled to said container.

9. A door operating assembly for a door including a first panel and a second panel pivotally mounted in a housing, said operating assembly including a frame, a teeter lever assembly mounted on said frame, a cylinder mounted on said frame, said cylinder including a reciprocating rod, said rod connected to said teeter lever assembly, a first connecting rod assembly connected to said teeter lever assembly and to said first panel, a second connecting rod assembly connected to said teeter lever assembly and to said second panel, the improvement comprising;

a vent in said cylinder, an accumulator, and means for communicating said vent and said accumulator.

10. The improvement in a door operating assembly set forth in claim 9 wherein said accumulator includes a closed container, and an adjustable relief valve connected to said cylinder, said cylinder being a pneumatic cylinder operated by a source of pressurized air at a predetermined pressure, said relief valve adjusted to a relief pressure less than the source pressure.

11. The improvement in a door operating assembly set forth in claim 9 further comprising a variable rate cam mounted on said teeter lever assembly, a return spring connected to said frame, a flexible connection member connecting said spring and said cam, said cam being of a configuration to provide, in the door closed position, a first moment arm between the spring and the point of connection of said cam to said teeter assembly and, in the door open position, to provide a second moment arm shorter than said first moment arm.

12. The improvement in a door operating assembly set forth in claim 11 wherein said flexible connection member comprises a chain.

13. A vehicle door operating system, comprising: a frame, a teeter lever assembly pivotally mounted on said frame, a cylinder with a reciprocating piston mounted on said frame, said piston including a rod secured to said teeter lever assembly, a connecting rod assembly connected to said teeter lever assembly and to a door of a vehicle, a spring with a first end secured to said frame, a flexible connection member connecting a second end of said spring to said teeter lever assembly, said teeter lever assembly including means for varying the moment arm for the force of said spring, said flexible connection member connected to said moment arm varying means, said moment arm varying means being a variable rate cam providing a first moment arm between said point of rotation and said spring in the door closed position and a second, shorter moment arm in the door open position.

14. The vehicle door operating system claimed in claim 13 wherein said flexible connection member comprises a chain.

15. The vehicle door operating system claimed in claim 13 further comprising a vent in said cylinder, a closed container on said frame, and means for communicating said container in said vent.

16. The vehicle door operating system claimed in claim 15 further comprising adjustable relief means for venting said container when pressure in said container exceeds a predetermined level, said predetermined level being less than pressure in said cylinder.

17. An air-open, spring-close door operator, comprising:

a frame, a teeter assembly mounted on said frame, a connecting rod assembly connected to said teeter assembly, a spring with a first end connected to said frame, a cylinder mounted on said frame, said cylinder including a piston and a piston rod, said piston rod connected to said teeter assembly, said cylinder including a piston vent, a closed container, and means for communicating said piston vent and said container.

18. The air-open, spring-close door operator claimed in claim 17 further comprising an adjustable relief valve in said container.

19. The air-open, spring-close door operator claimed in claim 18 wherein said adjustable relief valve is adjusted to a pressure less than pressure in said cylinder.

20. The air-open, spring-close door operator claimed in claim 17 wherein said teeter assembly further comprises a cam, said cam rotatably mounted to said frame at a point of rotation.

21. The air-open, spring-close door operator claimed in claim 20 further comprising flexible connection means for connecting said spring to said cam.

22. The air-open, spring-close door operator claimed in claim 20 wherein said spring is connected to said cam, said cam being a variable rate cam providing a first moment arm in a door closed position and a second, shorter moment arm in a door open position.

23. A door operating assembly for operating a door of a transit vehicle, said door including first and second panels, each said first and second panel including a door shaft, said operating assembly including a frame, a teeter lever assembly and a connecting rod assembly mounted on said frame, said connecting rod assembly connected to said door shafts for said first panel and said second panel to open and close said first panel and said second panel upon extension and retraction of said connecting rod assembly, said connecting rod assembly connected to said teeter lever assembly, a cylinder mounted on said frame, said cylinder including a reciprocating rod, and a return spring secured to said frame and to said teeter lever assembly, the improvement comprising:

a variable diameter cam on said teeter lever assembly, said cam rotatably mounted on said frame at a point of rotation of said cam, said reciprocating rod connected to said cam to rotate said cam, a flexible connection member also connected to said cam, said flexible connection member also connected to said spring.

24. The door operating assembly claimed in claim 23 wherein the moment arm between said point of rotation of said cam and said spring is larger in the closed position of said door than the moment arm in the open position of said door.

25. The door operating assembly claimed in claim 23 wherein said flexible member is a link chain.

26. The door operating assembly claimed in claim 23 further comprising an accumulator assembly connected to said cylinder.

27. The door operating assembly claimed in claim 26 wherein said cylinder includes a piston cushioning vent, said accumulator including a closed container secured to said frame, means for communicating said container and said vent.

28. The door operating assembly claimed in claim 27 further comprising an adjustable relief valve coupled to said container.

* * * * *